US009863627B2

(12) United States Patent
Kiselev

(10) Patent No.: US 9,863,627 B2
(45) Date of Patent: Jan. 9, 2018

(54) LED LAMP WITH FINS FUNCTIONING AS RADIATING HEAT SINKS

(71) Applicant: National Chemical Company LLC, Moscow (RU)

(72) Inventor: Anton Vladimirovich Kiselev, St. Petersburg (RU)

(73) Assignee: NATIONAL CHEMICAL COMPANY LLC, Moscow (RU)

( * ) Notice: Subject to any disclaimer, the term of this patent is extended or adjusted under 35 U.S.C. 154(b) by 43 days.

(21) Appl. No.: 14/920,532

(22) Filed: Oct. 22, 2015

(65) Prior Publication Data

US 2016/0116150 A1 Apr. 28, 2016

(30) Foreign Application Priority Data

Oct. 27, 2014 (RU) ..... 2014143128

(51) Int. Cl.

| | |
|---|---|
| ***F21V 29/74*** | (2015.01) |
| ***F21V 3/02*** | (2006.01) |
| ***F21V 29/77*** | (2015.01) |
| ***F21V 29/89*** | (2015.01) |
| ***F21V 3/04*** | (2006.01) |
| ***F21V 23/02*** | (2006.01) |
| ***F21K 9/23*** | (2016.01) |
| ***F21K 9/232*** | (2016.01) |
| *F21Y 115/10* | (2016.01) |
| *F21Y 107/30* | (2016.01) |

(52) U.S. Cl.

CPC ..... *F21V 29/74* (2015.01); *F21K 9/23* (2016.08); *F21K 9/232* (2016.08); *F21V 3/02* (2013.01); *F21V 3/0445* (2013.01); *F21V 23/02* (2013.01); *F21V 29/777* (2015.01); *F21V 29/89* (2015.01); *F21Y 2107/30* (2016.08); *F21Y 2115/10* (2016.08)

(58) Field of Classification Search

CPC . F21K 9/135; F21K 9/23; F21K 9/232; F21K 9/235; F21K 9/66; F21K 9/00; F21Y 2101/02; F21Y 2115/10

See application file for complete search history.

(56) References Cited

U.S. PATENT DOCUMENTS

| | | | | |
|---|---|---|---|---|
| 8,414,160 | B2 * | 4/2013 | Sun | F21V 29/2206 313/46 |
| 2012/0176796 | A1 * | 7/2012 | Bertram | F21V 29/004 362/249.02 |
| 2015/0077994 | A1 * | 3/2015 | Wang | F21V 29/77 362/241 |

* cited by examiner

*Primary Examiner* — Robert May

(74) *Attorney, Agent, or Firm* — Bardmesser Law Group

(57) ABSTRACT

An LED lamp includes a base, the transition insulating element connected therewith which is made of dielectric plastic with the cavity inside. The power supply is located on a PCT with the heat-conducting metal base and attached on the radiator. The radiator is made as rod-shaped section profile having side faces pointed at different directions, on which the LED modules are placed, as well as ribs extending therefrom. The radiator is within the diffuser made of plastic. The radiator has longitudinally oriented ribs located on a portion of radiator height and extending from the surface of the radiator between faces for formation of heat removal surfaces. The diffuser has a cap made as longitudinally oriented segmented shells, each located in front of LED modules of one face and covers them, isolating these LED modules from the ones on the adjacent face. Longitudinally oriented ribs are located between segmented shells.

1 Claim, 6 Drawing Sheets

LED LAMP WITH FINS FUNCTIONING AS RADIATING HEAT SINKS

CROSS-REFERENCE TO RELATED APPLICATION

This application claims priority to Russian Patent Application No. 2014143128, filed on Oct. 27, 2014, incorporated by reference herein in its entirety.

BACKGROUND OF THE INVENTION

Field of the Invention

This application relates to the field of lighting technology, and, in particular to lighting fixtures, and is intended for use in domestic and industrial multipurpose lighting instruments.

Description of the Related Art

The main distinctive feature of the LED lamp is distribution of its light flux in the environment. Subject to shapes and dimensions generally accepted for incandescent lamps, the LED lamp provides uniformly distributed diffused light, and unlike most modern lamps, the beam angle does not correspond with lamps replaced thereby.

Thus, a conventional lighting LED lamp includes a base, a transition element (insulator) connected therewith, which is made of dielectric plastic with an additional cavity in the middle. A power supply for lamp operation in electrical networks is located therein, which is connected with an LED module made on a printed circuit board with a heat-conducting metal base and mounted on a radiator. The radiator is made as rod-shaped profile of a complex cross section having side planes pointed at different directions, on which LED modules are placed. The radiator is placed within a diffuser made of plastic which is close to glass in terms of optical performance. The LED modules on each radiator face are placed in front of diffuser sections located between radial projections on the diffuser (see US Patent Publication No. 2012/0313518).

The process of generating distributed diffused light in this LED lamp is such that light from the LED modules passes through the thin transparent plastic wall into the environment, while a portion of the light falls on walls of radial projections and is reflected from their surface. Thus, combinative lighting of the space in the area of 360° around the diffuser is ensured.

The diffuser has a complex spatial shape of a shell with radial ribs, such that the shell center opposite to the base has a through hole for heat removal from the radiator. However, this heat removal method is inefficient because it does not ensure removal of heat from the entire surface of such a rod-shaped radiator. At the same time, the radiator's bottom is spatially adjacent to the power supply of the LED modules located in the base. Thus, the bottom of the radiator is constantly overheated, while heat removal from the radiator top through the fixed orifice using convection in the diffuser is not very efficient. Presence of excessive heat in the radiator bottom results in that heat affects diffuser plastic. Even when using such plastic as polycarbonate (light permeability and transparence are up to 86%) resistant to a wide range of high temperatures (up to 120° C.), constant heating leads to material structure darkening, which impacts on diffusion quality of LED light flux. Special coatings, which reduce impact of heat radiation on the material structure are used for polycarbonate, but these coatings cannot always be used for lighting technology.

It is known that efficiency factor of powerful LEDs is a higher than that of incandescent lamps. On the other hand, most of energy consumed by LEDs (about 75%) is still spent for dissipated heat. Heat emission is increased along with growth of light flux from LED sources. According to estimates provision of efficient heat removal in LED lighting technology is one of the most crucial problems that faces developers and manufacturers of these products today.

Unlike conventional incandescent and gas discharge lamps, modern LEDs are sensitive to high temperatures:

First, when a LED is overheated, its efficiency is reduced, its light flux is weakened, its color temperature is changed, and its service life can decrease considerably;

Second, luminosity intensity is decreased approximately by 15% at the temperature of 80° C. as compared to intensity at the room temperature. As a result, the lighting fixture with twenty LEDs at a temperature of 80° C. can have light flux equivalent to the flux of seventeen LEDs at the room temperature. Intensity of LED light may be reduced by 40% at the transition temperature of 150° C.

Third, LEDs have a negative temperature factor of forward voltage, i.e., forward voltage of LEDs is reduced upon a temperature increase. Usually this factor comprises −3 to −6 mV/K, that is why forward voltage of a standard LED may comprise 3.3 V at +25° C. and not more than 3 V at +75° C. If the power supply does not allow reducing current on LEDs, this may result in further overheating and breakdown of LEDs. Moreover, many power supplies for LED lighting fixtures are designed for the operating temperature of up to +70° C.

Therefore, it is important to provide the temperature of not more than 80° C. both in the p-n-junction area and in the power supply area for efficient operation of LED devices. Failure to observe recommended temperature conditions can result in light quantity and quality loss, increased costs of the LED device, as well as reduction of service life of a lighting device.

SUMMARY OF THE INVENTION

This invention relates to an LED lamp that substantially obviates one or more of the disadvantages of the related art.

The present invention is directed to an LED lamp including a base, and a transition insulating element connected to the base, the transition insulating element formed of a dielectric plastic; the transition insulating element having a cavity inside it. A power supply is located in the cavity, the power supply being connected to a plurality of LED modules. Each of the LED modules is made on a printed circuit board with the heat-conducting metal base and attached on the radiator. The radiator has a central part having a rod-shaped section profile and ribs. The central part includes side faces pointed at different directions. The LED modules are located are on the side faces. The LED modules are placed inside the diffuser made of transparent plastic. The diffuser includes outer surface sections stretched in a direction from the base and inner sections sunk between surfaces, such that the LED modules are placed on radiator faces inside the diffuser in front of the inner sections. The radiator includes longitudinally oriented ribs located at least on a portion of radiator height and extending from the surface of the central part between its faces so as to form heat removal surfaces. The diffuser functions as a cap having longitudinally oriented segmented shells having separate longitudinally oriented segmented shells. Each of the shells located in front of the LED modules of one face of the central part and covers the LED modules, thereby insulating these LED modules from the LED modules on an adjacent face. The longitudinally oriented ribs are located between the shells.

Additional features and advantages of the invention will be set forth in the description that follows, and in part will be apparent from the description, or may be learned by practice of the invention. The advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE ATTACHED FIGURES

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

Reference will now be made in detail to the preferred embodiments of the present invention, examples of which are illustrated in the accompanying drawings.

The present invention is aimed at enhancement of operational reliability of the LED lamp by provision of efficient heat removal from the entire radiator surface throughout its height.

The specified technical result is achieved in that inside the general lighting LED lamp which includes a base, a transition insulating element connected therewith, which is made of dielectric plastic with the cavity inside, wherein the power supply for lamp operation in electrical networks is located, which is connected with LED modules made on the printed circuit board with the heat-conducting metal base and attached on the radiator. The radiator has a central part of rod-shaped section profile and ribs. The central part of the radiator is made with side faces pointed at different directions on which the LED modules are located, and placed inside the diffuser made of plastic which is close to glass in terms of optical performance. The diffuser is made with outer surface sections stretched in the direction from the base and inner sections sunk between surfaces, in front of which LED modules are placed on radiator faces inside the diffuser. The radiator is made with longitudinally oriented ribs located at least on a portion of radiator height and extending from the surface of the radiator central part between its faces for formation of heat removal surfaces. The diffuser represents a cap made as longitudinally oriented segmented shells, or the diffuser is made as separate longitudinally oriented segmented shells, each of which is located in front of LED modules of one face of the radiator central part and covers them, thereby isolating these LED modules from the ones on the adjacent face. The longitudinally oriented ribs are located between segmented shells.

The specified features are interrelated with formation of a stable combination of features, which is sufficient for achievement of the required technical result.

Figure 2:
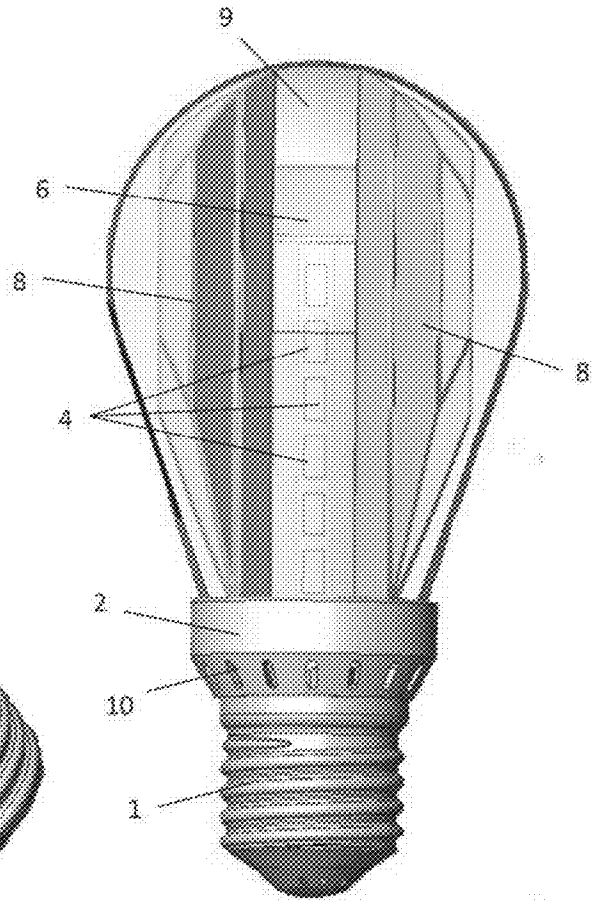
FIG. 2 is the lamp sideview of the transparent diffuser section on LED modules.
Figure 1:
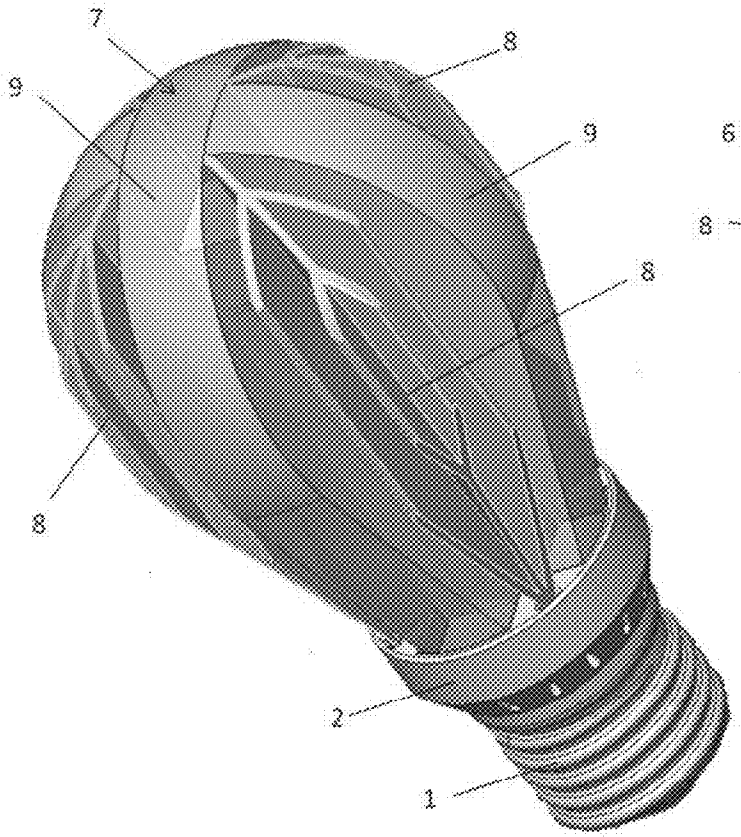
FIG. 1 is the general view of the LED lamp for installation into standard electric holders (electrical holders)
Figure 4:
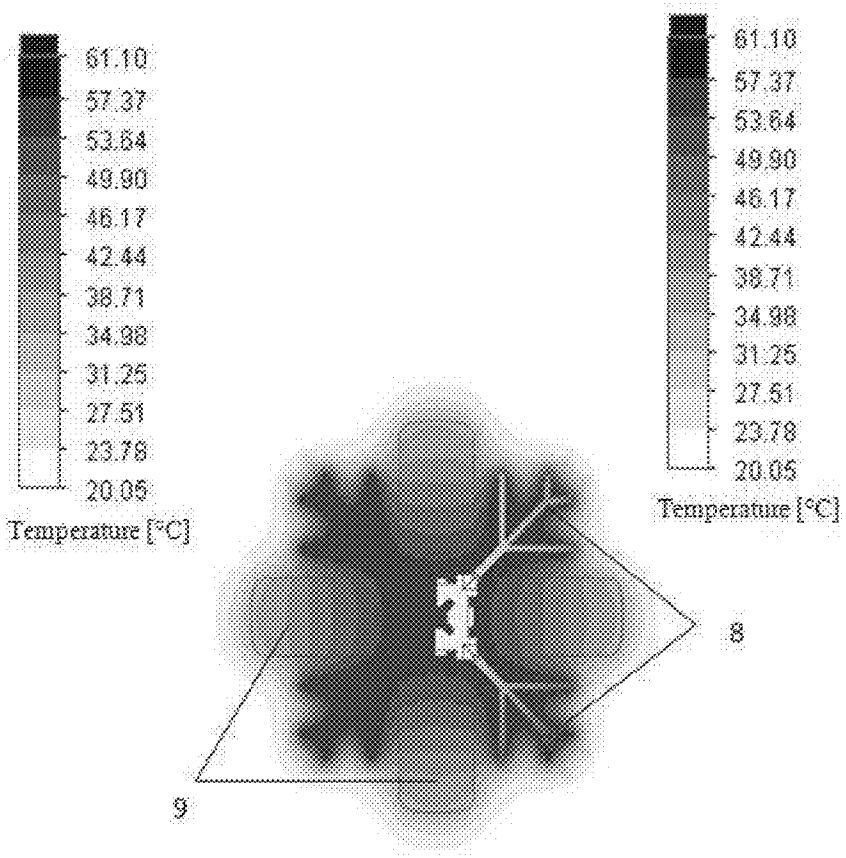
FIG. 4 shows heat distribution in terms of temperature along the radiator cross section.
Figure 3:
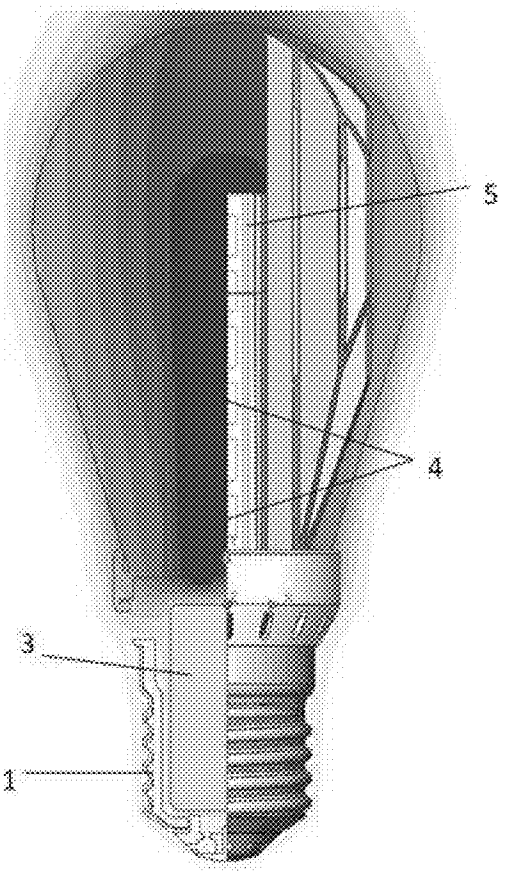
FIG. 3 shows heat distribution in terms of temperature along the radiator height.
Figure 6:
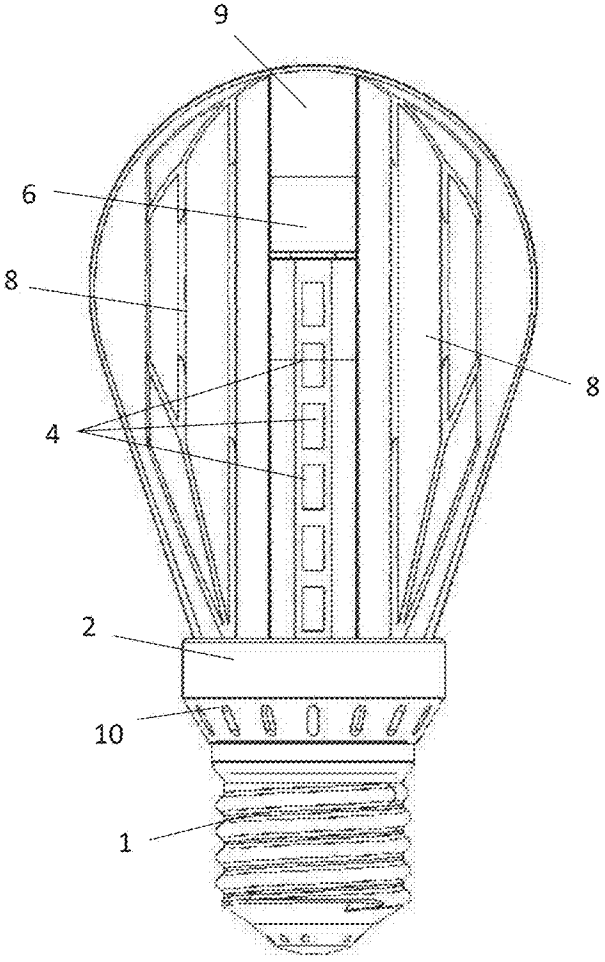
FIGS. 5-8 show additional views of the LED lamp of the present invention.
Figure 5:
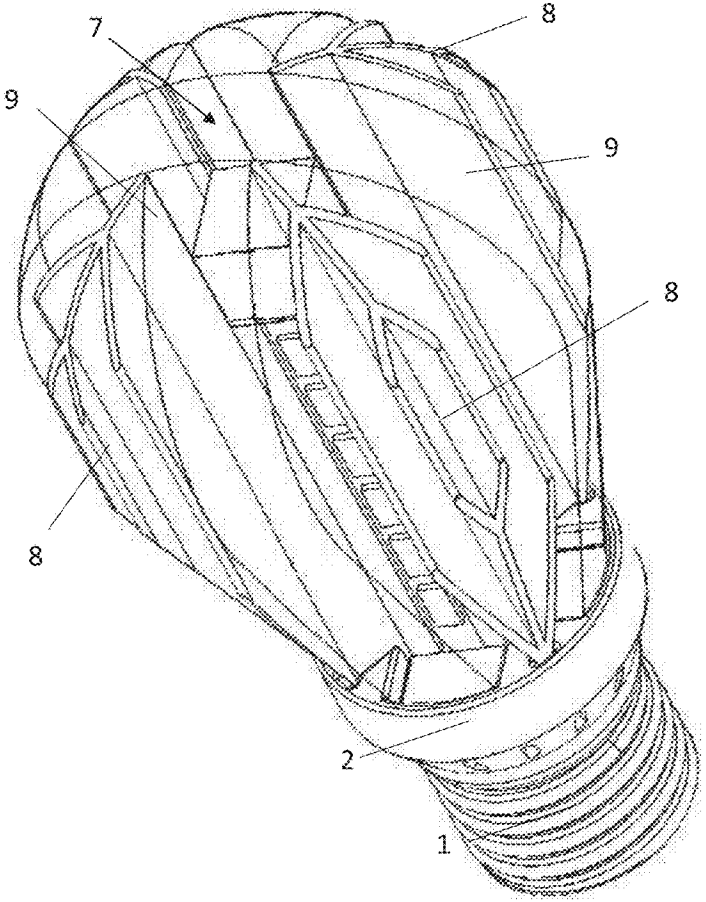
Figure 7:
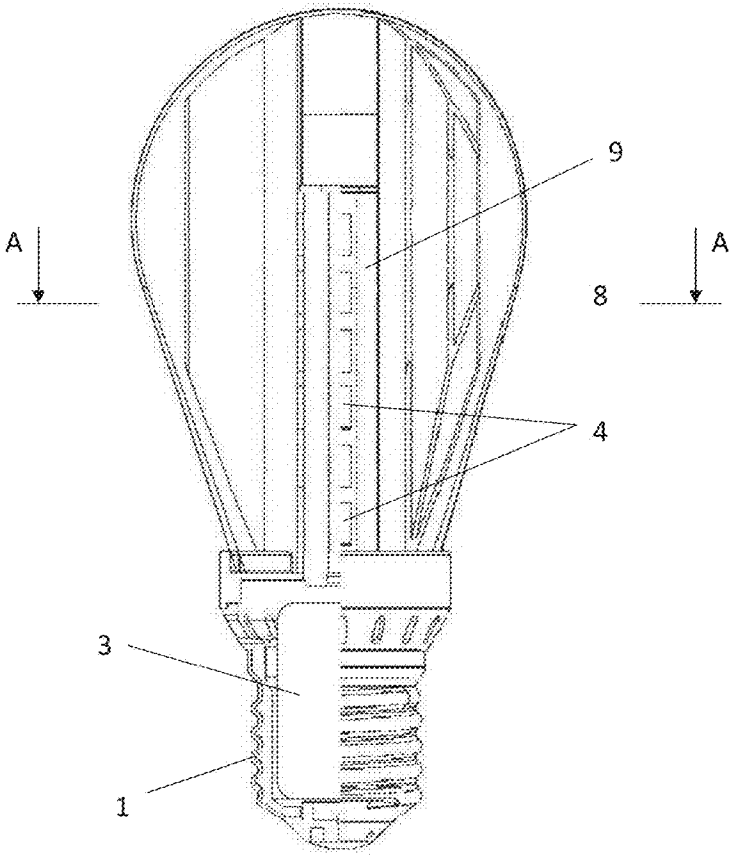
Figure 8:
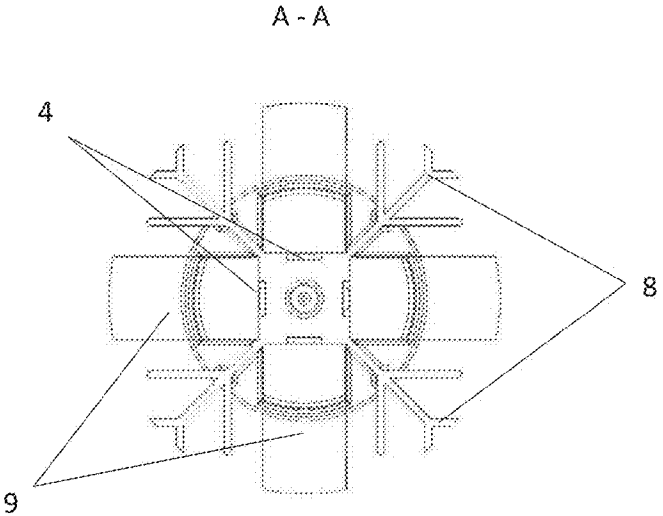

FIG. 1 is a general view of the LED lamp for installation into standard electric holders (electrical holders);

FIG. 2 is a lamp sideview of the transparent diffuser section on LED modules;

FIG. 3 shows heat distribution in terms of temperature along the radiator height; and FIG. 4 shows heat distribution in terms of temperature along the radiator cross section.

The structure of the general lighting LED lamp designed for installation into standard electrical rockets (electrical holders) such as E27 (E26, E14, E12, E17, B22d, B15d) is considered. This lamp is made in standard (conventional/common) sizes for replacement of the corresponding utility light sources. Lighting modules which represent one-sided printed circuit boards of higher heat conduction with LEDs uniformly located thereon and incorporated by the combined scheme are placed under the diffuser made of lighting plastic. LEDs in modules are located in such a manner that they create uniform distribution of light flux from the lamp in all directions in space (360°). The lamp body and base enclose the power supply for operation in alternating current systems 220 V/50 Hz. The main problem solved by the suggested LED lamp is an LED lamp which has high operational reliability, enhanced lighting efficiency (owing to uniform distribution of light flux in all directions).

The general lighting LED lamp (FIGS. 1 and 2) includes a base 1, a transition insulating element 2 (insulator) connected therewith, which is made of dielectric plastic with the cavity inside, wherein a power supply 3 for operation of the lamp in electrical networks is located. This power supply 3 is connected with LED modules 4 made on a printed circuit board with a heat-conducting metal base and attached on a radiator 5.

The radiator 5 has a central part of rod-shaped cross-section profile, with side faces 6 pointed at different directions, on which the LED modules 4 are located.

The radiator 5 is placed inside a diffuser 7 made of plastic, which is close to glass in terms of optical performance. The radiator is made with longitudinally oriented ribs 8 located at least on a portion of radiator height and extending from the surface of the radiator between faces for formation of heat removal surfaces. The radiator is made as a complex cross-section profile with longitudinally oriented ribs on the outside, which lie in the planes passing through the lamp axis. The radiator is preferably made of aluminum or light alloys of aluminum, copper or ceramics.

The diffuser 7 represents a cap made as longitudinally oriented segmented shells 9, or the diffuser is made as separate longitudinally oriented segmented shells 9 of different shape (depending on the lamp type), each of which is located in front of the LED modules 4 of one face 6 and covers them, thereby isolating these LED modules from the ones on the adjacent face. The diffuser of complex shape in vertical section represents a common lamp shape and is made of plastic which is close to glass in terms of optical performance, e.g., polycarbonate.

Longitudinally oriented ribs 8 of the radiator are located between segmented shells 9 in such a manner that a part of the radiator with LEDs is located within the group of diffusers. The radiator has a complex cross-section profile with longitudinally oriented ribs on the outside, which lie in the planes passing through the lamp axis, installed into slots of the body made of dielectric plastic and attached thereto mechanically. The body is also mechanically connected with the base insulator. The insulator has through holes 10 for additional heat removal from the location of the power supply.

Figure 9:
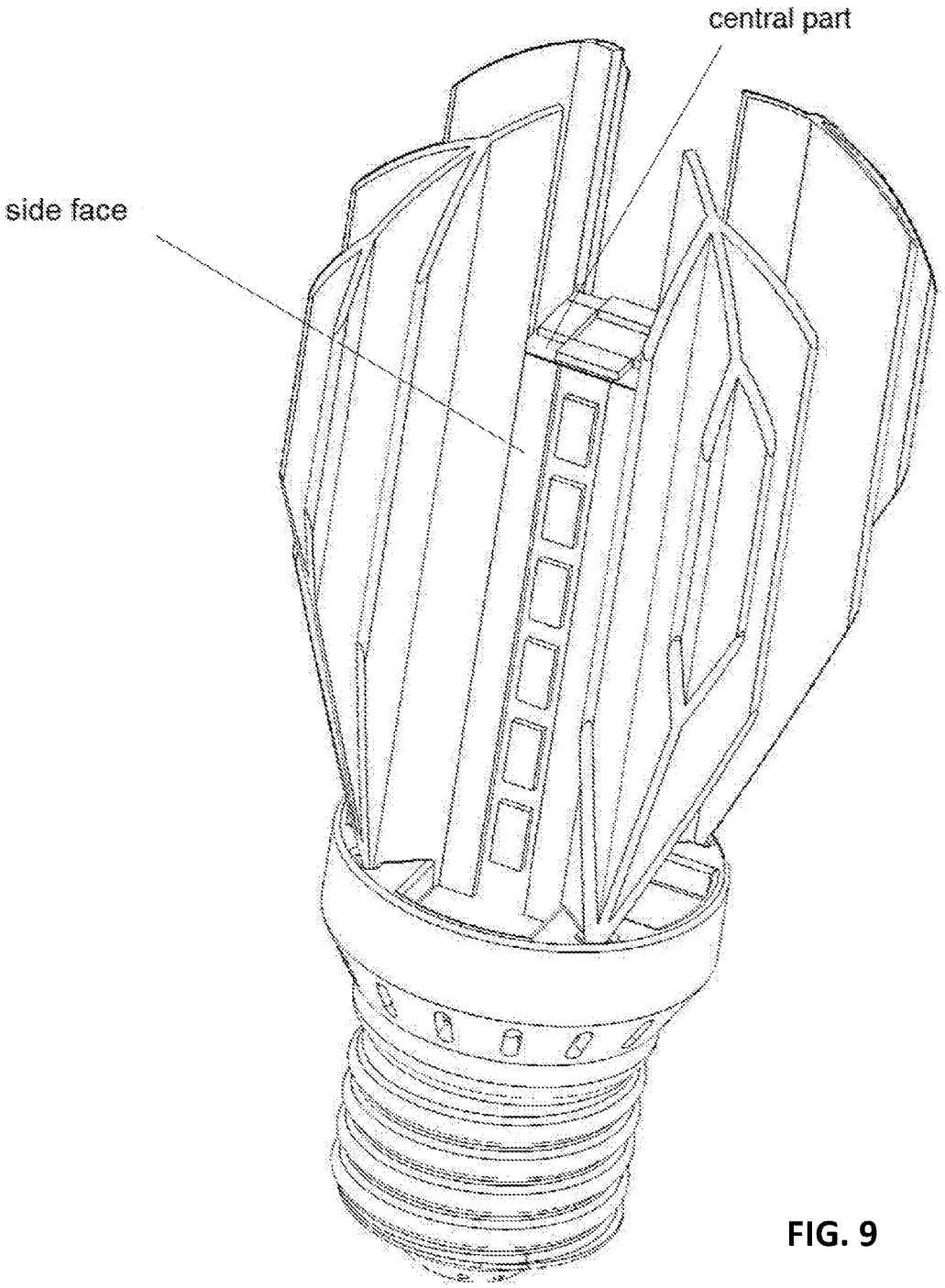
FIG. 9 shows a partial view of the central portion of the LED lamp.
Figure 10:
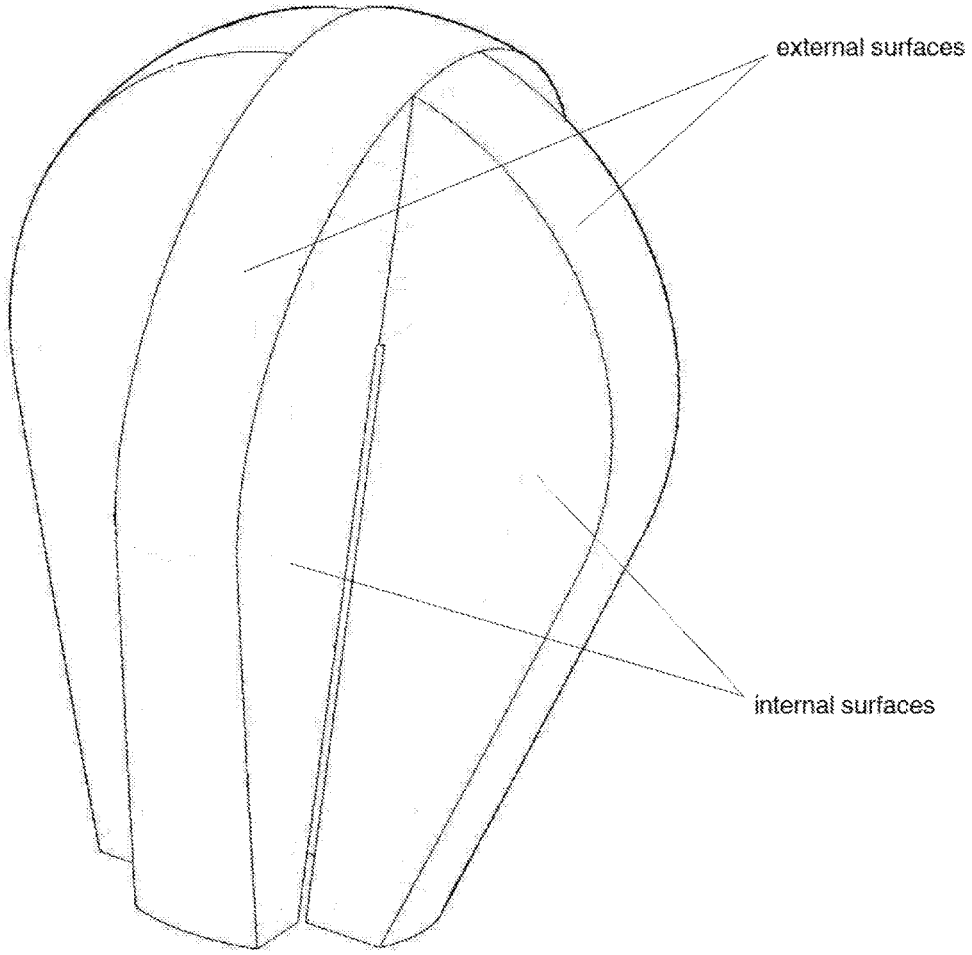
FIG. 10 shows a partial view of the LED lamp, showing only the diffuser.

FIGS. 5-8 show additional views of the LED lamp of the present invention. FIG. 9 shows a partial view of the central portion of the LED lamp (roughly square in cross-section in this figure, although the invention is not limited to a square cross-section). FIG. 10 shows a partial view of the LED lamp, showing the external and internal surfaces of the diffuser.

LEDs in the LED lamp are divided into several groups (modules) connected with each other into series or parallel or series-parallel or parallel-series circuits. LED modules are made with heat-conducting metal bases and installed on the radiator body. Modules are located in such a manner as to ensure uniform distribution of light flux in the inner volume of diffuser segments and thus the general light flux of the lamp. LEDs on the board are located in such a manner as to ensure uniform terminal flash of diffuser material.

Therefore, the feature of the LED lamp is that LEDs on each radiator face are located in their own transparent shells, providing direct emission onto the end surface and side surfaces of the shell. However, it should be noted in this respect that the most common method of removal of excess heat from powerful LEDs and microcircuits is its transfer to the printed circuit board (including boards with a metal base, such as MC (metal core) PCB, AL (Aluminum) PCB, IM (insulated metal) PCB), substrate or other structural elements of an electronic device. It is also possible to install the radiator on an overheated component (or an overheated component on the radiator), which increases the area of radiative and convective interchange. Then heat is transferred to the environment mainly by way of convection. But surfaces of a heat source and heat absorber have undulations and irregularities in real life. Gaps (microcavities) which contain air appear in most cases upon contact of planes. As a result, contact between planes occurs at points rather than planes, thereby considerably increasing effective thermal resistance. It is important to remember that air has a heat conductivity factor of about 0.02 W/mK, which is very low, and approximately 40 times lower than that of typical thermal conductive pastes.

Thus, high resistance to heat flux appears between contact surfaces due to presence of air, and heat removal efficiency is decreased significantly. Heat-conductive material that fills gaps is used in order to prevent this negative effect due to presence of air. In this case, module heat is transferred to the radiator upon contact. At the same time, heat is removed by ribs, which are withdrawn outside and located exterior to segments. Accordingly, temperature does not increase above the set level inside segmented shells.

Studies have shown (see FIGS. 3 and 4) that upon long-term operation of the LED lamp the temperature of the radiator and its withdrawn ribs does not exceed 61° C., and the temperature within segmented shells is in the range of 40° C. These figures indicate absence of overheating of LEDs on the radiator. Thus, efficiency of LEDs is preserved, and light flux is maintained at the high-quality level without any change of color temperature.

Having thus described a preferred embodiment, it should be apparent to those skilled in the art that certain advantages of the described method and apparatus have been achieved. It should also be appreciated that various modifications, adaptations, and alternative embodiments thereof may be made within the scope and spirit of the present invention. The invention is further defined by the following claims.

What is claimed is:

1. An LED lamp comprising:

a heat-conducting metal base;

an insulating element connected to the base, the insulating element formed of a dielectric plastic and having a cavity therein;

a power supply unit located in the cavity, the power supply unit being connected to a plurality of LED modules;

wherein each of the LED modules is mounted on an insulated metal substrate printed circuit board or on an insulated metal core printed circuit board, and each LED module is attached to a heat sink;

wherein the heat sink has a central part having a rod- or bar-shaped section profile and includes side faces facing different directions, whereon the LED modules are located are on the side faces, and wherein the LED modules are placed inside a diffuser made of transparent plastic;

wherein the diffuser includes external surface sections, the external surface sections extending from the heat-conducting metal base, and the diffuser also including internal surface sections extending inward between edges of the external surface sections, the internal surface sections extending from the heat-conducting metal base surfaces, such that the LED modules are placed on heat sink side faces inside the diffuser in front of the internal external surface sections;

wherein the heat sink includes longitudinally oriented ribs located at least on a portion of heat sink height and extending from a surface of the central part between the heat sink side faces so as to form heat removal surfaces; and the diffuser functions as a cover being segmented into longitudinally oriented shells, each of the shells located in front of the LED modules of one side face of the central part with the shell covering the LED module such that each LED module on each side face is located in its own transparent shell, thereby isolating each LED module from the LED modules on adjacent side faces, and wherein the longitudinally oriented ribs are located between the shells.

* * * * *